US007252044B2

(12) United States Patent
Lee

(10) Patent No.: US 7,252,044 B2
(45) Date of Patent: Aug. 7, 2007

(54) STEPPED EMBROIDERY MACHINE

(75) Inventor: Hyung Woo Lee, Incheon (KR)

(73) Assignee: Sunstar Precision Co., Ltd. (KR)

( * ) Notice: Subject to any disclaimer, the term of this patent is extended or adjusted under 35 U.S.C. 154(b) by 77 days.

(21) Appl. No.: 11/190,463

(22) Filed: Jul. 27, 2005

(65) Prior Publication Data

US 2006/0021558 A1 Feb. 2, 2006

(30) Foreign Application Priority Data

Jul. 27, 2004 (KR) ..... 10-2004-0058502

(51) Int. Cl.
*D05C 5/02* (2006.01)

(52) U.S. Cl. ..... 112/102.5

(58) Field of Classification Search ..... 112/102.5, 112/78, 99, 102, 103, 155, 470.18, 470.06
See application file for complete search history.

(56) References Cited

U.S. PATENT DOCUMENTS 5,474,001 A * 12/1995 Tajima et al. ..... 112/102.5
5,937,774 A * 8/1999 Hayashi ..... 112/103
6,698,369 B2 * 3/2004 Kwak ..... 112/102.5
6,874,437 B2 * 4/2005 Kim ..... 112/102.5
6,925,946 B1 * 8/2005 Kang ..... 112/102.5
2003/0177971 A1 * 9/2003 Kim ..... 112/102.5

* cited by examiner

*Primary Examiner*—Danny Worrell
(74) *Attorney, Agent, or Firm*—Grossman, Tucker, Perreault & Pfleger, PLLC

(57) ABSTRACT

Disclosed is a stepped embroidery machine. The stepped embroidery machine includes a plurality of head units including heads, embroidery frames installed at lower portions of the heads is such a manner that the embroidery frames are movable in X-axis and Y-axis directions, X-axis drive units for moving the embroidery frames in an X-axis direction, and Y-axis drive units for moving the embroidery frames in a Y-axis direction, a control unit for controlling an operation of the head units, and a control panel used for inputting and displaying information related to embroidery work and embroidery. The head units are individually driven per each head unit and aligned in a stepped pattern while forming a predetermined step difference therebetween. Since the head units are individually driven, it is possible to individually perform embroidery work with respect to various workpieces. The head units are aligned in the stepped pattern while forming a predetermined step difference therebetween, so the head units do not interfere with each other even if the embroidery machine performs the embroidery work with respect to workpieces having a large area. The head units are controlled with one control unit and one control panel, so the worker simultaneously controls the head units of the embroidery machine without changing positions of the worker, facilitating the embroidery work.

8 Claims, 7 Drawing Sheets

STEPPED EMBROIDERY MACHINE

BACKGROUND OF THE INVENTION

1. Field of the Invention

The present invention relates to a stepped embroidery machine. More particularly, the present invention relates to a stepped embroidery machine having a single body and a plurality of head units aligned in a stepped pattern while forming a step difference therebetween for simultaneously and individually performing embroidery work with respect to various workpieces.

2. Description of the Prior Art

As generally known in the art, an automatic embroidery machine embroiders patterns on a workpiece fixed to an embroidery frame by moving the embroidery frame in X-axis and Y-axis directions while actuating a needle up and down with respect to the workpiece. That is, differently from a sewing machine which sews a cloth by using a needle moving up and down with respect to the cloth while passing the cloth through a sewing area of the sewing machine by means of a moving table having a toothed structure, the embroidery machine embroiders patterns on the workpiece by moving the embroidery frame in the X-axis and Y-axis directions, so the speed and movement of the embroidery frame may closely relate to quality of embroidery patterns.

According to the conventional embroidery machine, a plurality of heads and shuttles are simultaneously driven when a spindle shaft rotates, thereby embroidering patterns on the workpiece fixed to the embroidery frame. Therefore, the conventional embroidery machine presents a problem in that it can be used only for single embroidery work for a single workpiece.

In order to solve the above problem, applicant of the present invention has developed an embroidery machine equipped with a plurality of head units capable of simultaneously and individually performing embroidery work with respect to various workpieces. The above embroidery machine has been filed with Korean Intellectual Property Office and registered with Korean Utility Model Registration No. 350914.

The embroidery machine disclosed in Korean Utility Model Registration No. 350914 includes a plurality of head units, which are divided into at least two working groups, and embroidery frames provided in each working group. The embroidery frames have the same structure or mutually different structures.

However, since the embroidery machine must be equipped with a plurality of head units for individually performing the embroidery work with respect to various workpieces, the size of the embroidery machine may become enlarged as compared with that of the embroidery machine having one head unit. In addition, in order to facilitate the embroidery work, the embroidery frames installed corresponding to the plural head groups must be prevented from interfering with each other. For this reason, it is necessary to ensure a sufficient interval between the embroidery frames, resulting in the large-sized embroidery machine.

The large-sized embroidery machine does not match with the current tendency of providing a compact-sized embroidery machine suitable for a narrow place.

SUMMARY OF THE INVENTION

Accordingly, the present invention has been made to solve the above-mentioned problems occurring in the prior art, and an object of the present invention is to provide a stepped embroidery machine including a plurality of head units, which can be individually operated in such a manner that embroidery work can be individually performed with respect to various workpieces, wherein the head units are aligned in a stepped pattern while forming a step difference therebetween so that the head units may not interfere with each other even if the embroidery work is performed with respect to workpieces having a large area, and the head units can be controlled by means of one control unit and one control panel so that a worker can simultaneously control the head units of the embroidery machine without changing positions of the worker, facilitating the embroidery work.

Another object of the present invention is to provide a stepped embroidery machine having a plurality of head units aligned in a stepped pattern while forming a step difference therebetween, whereby the size of the stepped embroidery machine can be reduced so that the stepped embroidery machine can be formed with a compact size suitable for a narrow place and the embroidery work can be individually performed with respect to various workpieces.

Still another object of the present invention is to provide a plurality of stepped embroidery machines, which can be aligned in series such that at least two working groups are formed for embroidering patterns on a plurality of workpieces within a limited space.

To accomplish the above objects, according to the present invention, there is provided stepped embroidery machine comprising: a plurality of head units including heads, embroidery frames installed at lower portions of the heads is such a manner that the embroidery frames are movable in X-axis and Y-axis directions, X-axis drive units for moving the embroidery frames in an X-axis direction, and Y-axis drive units for moving the embroidery frames in a Y-axis direction; a control unit for controlling an operation of the head units; and a control panel used for inputting and displaying information related to embroidery work and embroidery, wherein the head units are individually driven per each head unit and aligned in a stepped pattern while forming a predetermined step difference therebetween.

The embroidery frames of the head units are overlaid with each other in a stepped pattern at a maximum operational range thereof.

Preferably, each embroidery frame of the head unit includes at least one of a tubular frame unit and a cap frame drive unit.

Only one control unit is provided in order to control an operation of the head units in such a manner that the head units simultaneously embroider same embroidery patterns or mutually different embroidery patterns on workpieces.

Preferably, only one control panel is provided in the embroidery machine.

The control panel includes a detachable control panel.

The control panel includes a display screen for displaying an embroidery pattern, which is selected from various embroidery patterns being embroidered on workpieces by means of the head units according to a selection of a worker.

The control panel includes a display screen for simultaneously displaying various embroidery patterns being embroidered on workpieces by means of the head units by dividing the display screen into several display parts.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Hereinafter, a preferred embodiment of the present invention will be described with reference to the accompanying drawings.

Figure 1:
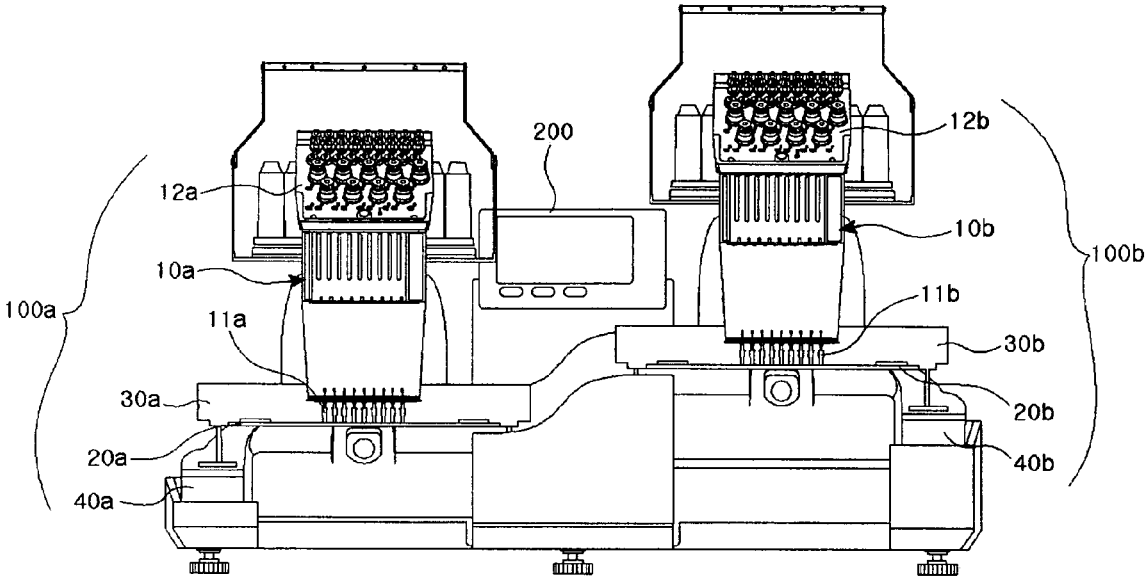
FIG. 1 is a front view illustrating a stepped embroidery machine according to one embodiment of the present invention.

FIG. 1 is a front view illustrating a stepped embroidery machine according to one embodiment of the present invention.

Referring to FIG. 1, the stepped embroidery machine of the present invention mainly includes a plurality of head units 100*a* and 100*b*, a control unit (not shown) and a control panel 200. The head units 100*a* and 100*b* include heads 10*a* and 10*b*, embroidery frames 20*a* and 20*b*, X-axis drive units 30*a* and 30*b*, Y-axis drive units 40*a* and 40*b*, and driving units (not shown), respectively. The head units 100*a* and 100*b* are aligned in a stepped pattern while forming a step difference therebetween in such a manner that they can be individually driven in order to individually perform embroidery work.

According to the preferred embodiment of the present invention, the stepped embroidery machine includes two head units having a single head, respectively. However, the present invention does not limit the number of head units and the number of heads forming the head unit. For instance, a multi-head embroidery machine having a plurality of head units or working groups including a plurality of heads can be provided within the scope of the present invention.

The control unit controls the operation of the head units 100*a* and 100*b*, respectively, in such a manner that the head units 100*a* and 100*b* can selectively embroider the same pattern or different patterns on the workpiece.

The control panel 200 allows a user to input data required for the embroidery work and transmits the data to the control unit or receives result data from the control unit in order to display the result data in an LCD screen. Preferably, the control panel 200 is a touch screen including a display section and a key-input section.

In addition, it is preferred to provide only one control unit and one control panel 200 in order to simplify the structure of the embroidery machine and to reduce the manufacturing cost for the embroidery machine.

In the meantime, the head units 100*a* and 100*b* include heads 10*a* and 10*b*, embroidery frames 20*a* and 20*b*, X-axis drive units 30*a* and 30*b*, and Y-axis drive units 40*a* and 40*b*, respectively.

The heads 10*a* and 10*b* are provided at upper portions thereof with yarn hangers 12*a* and 12*b* and at lower portions thereof with needle sections 11*a* and 11*b*, respectively. The needle sections 11*a* and 11*b* including a plurality of needles are selectively used and yarns having various colors are fed into the needle sections 11*a* and 11*b* under the control of a color change unit (not shown) so that the embroidery machine can continuously perform the embroidery work.

The embroidery frames 20*a* and 20*b* are installed at lower portions of the heads 10*a* and 10*b* in such a manner that the embroidery frames 20*a* and 20*b* can move in X-axis and Y-axis directions. The embroidery frames 20*a* and 20*b* fix workpieces when performing the embroidery work. If it is necessary to embroider patterns on workpieces made from finished fabrics, a tubular frame unit can be additionally provided in the embroidery machine. In addition, if it is necessary to embroider patterns on cap-shaped workpieces, a cap frame drive unit can be additionally provided in the embroidery machine. Furthermore, if it is necessary to embroider patterns on flat workpieces, a border frame can be additionally provided in the embroidery machine.

Figure 3A:
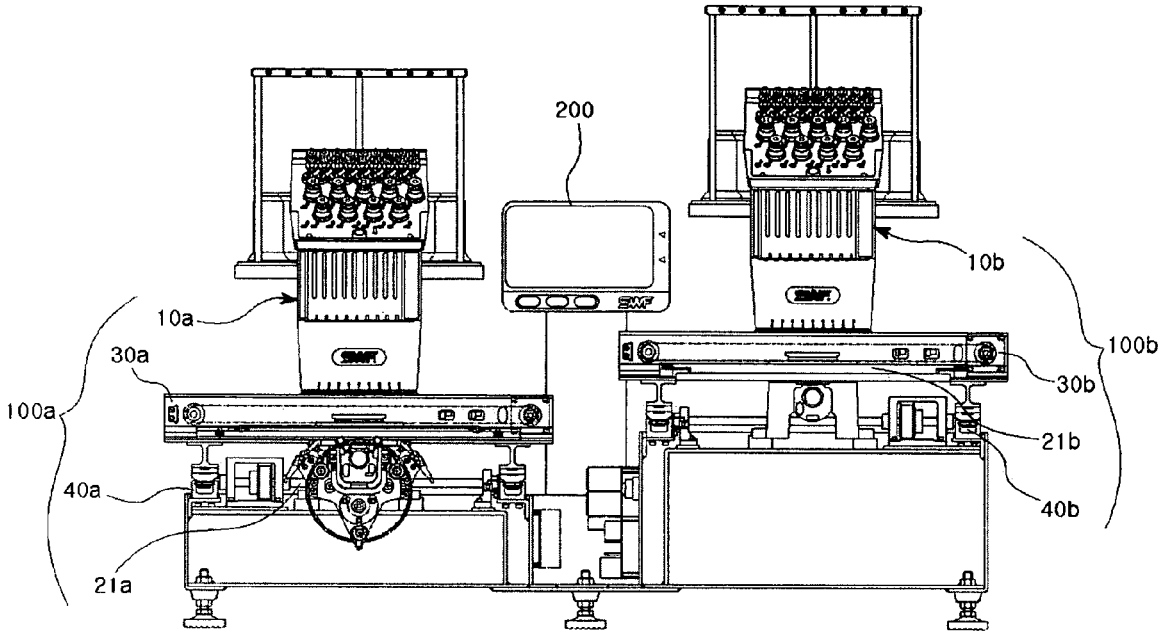
FIGS. 3*a* and 3*b* are front and plan views illustrating a stepped embroidery machine equipped with a tubular frame unit and a cap frame drive unit according to one embodiment of the present invention.
Figure 3B:
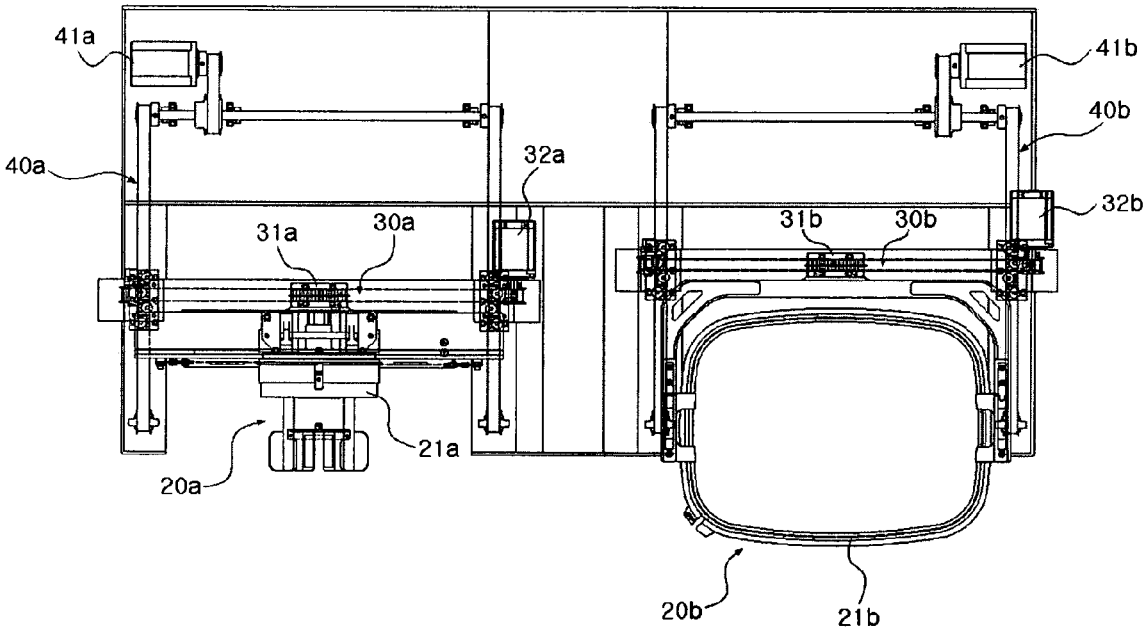

As shown in FIG. 3*b*, the X-axis drive units 30*a* and 30*b* are provided at inner portions thereof with frame holders 31*a* and 31*b* for fixing the embroidery frames 20*a* and 20*b* and move the embroidery frames 20*a* and 20*b* in the X-axis direction according to the operation of X-axis driving motors 32*a* and 32*b*.

The Y-axis drive units 40*a* and 40*b* are aligned at lower portions of the X-axis drive units 30*a* and 30*b* perpendicularly to the X-axis drive units 30*a* and 30*b*. As shown In FIG. 3*b*, the Y-axis drive units 40*a* and 40*b* move the embroidery frames 20*a* and 20*b* and the X-axis drive units 30*a* and 30*b*, which are installed at upper portions of the Y-axis drive units 40*a* and 40*b*, in the Y-axis direction according the operation of Y-axis driving motors 41*a* and 41*b*.

Figure 2A:
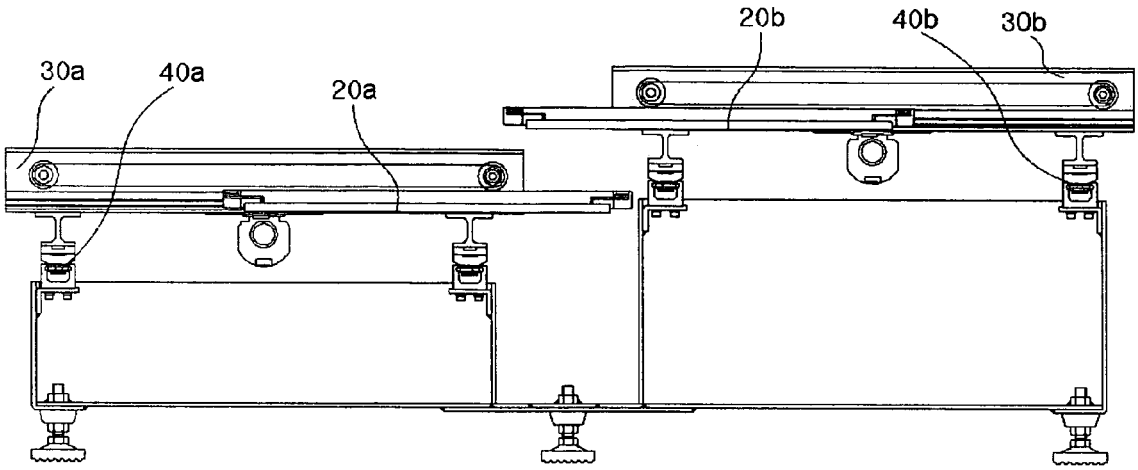
FIGS. 2*a* and 2*b* are front and plan views illustrating an operational range of an embroidery frame of a stepped embroidery machine according to one embodiment of the present invention.
Figure 2B:
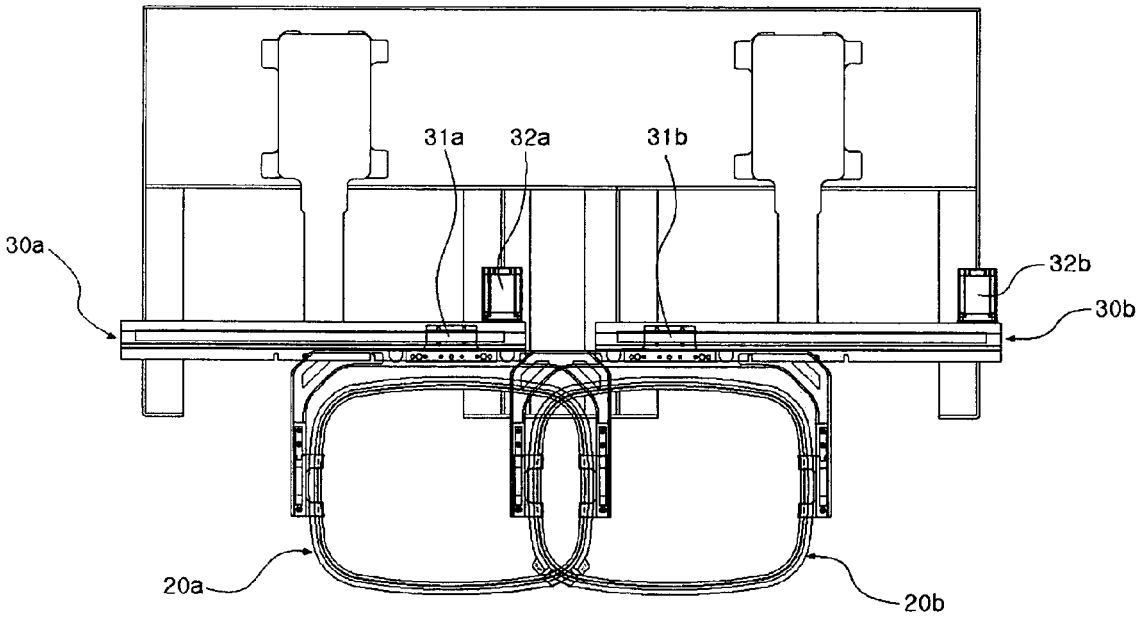

FIGS. 2*a* and 2*b* are front and plan views illustrating an operational range of the embroidery frame of the stepped embroidery machine according to one embodiment of the present invention.

Referring to FIGS. 2*a* and 2*b*, the stepped embroidery machine includes two embroidery frames 20*a* and 20*b* forming two head units 100*a* and 100*b*, two X-axis drive units 30*a* and 30*b* on which the embroidery frames 20*a* and 20*b* are installed, and Y-axis drive units 40*a* and 40*b*.

As shown in FIGS. 2*a* and 2*b*, since the embroidery frames 20*a* and 20*b* are aligned in a stepped pattern while forming the step difference therebetween, the embroidery frames 20*a* and 20*b* may not interfere with each other even if the embroidery frames 20*a* and 20*b* are shifted with a maximum operational range.

As a result, it is possible to significantly reduce the width of the embroidery machine, so that the size and weight of the embroidery machine can be reduced while improving space efficiency for the embroidery machine.

FIGS. 3*a* and 3*b* are front and plan views illustrating the stepped embroidery machine equipped with a tubular frame unit and a cap frame drive unit according to one embodiment of the present invention.

The head units 100*a* and 100*b* can be provided with various types of embroidery frames as required by the worker. For instance, at least one of the tubular frame unit, the cap frame drive unit and the border frame can be provided in the head units 100*a* and 100*b*.

Referring to FIGS. 3*a* and 3*b*, the stepped embroidery machine according to one embodiment of the present invention includes a pair of head units 100*a* and 100*b* equipped with a cap frame drive unit 21*a* and a tubular frame unit 21, respectively, a control unit (not shown) and a control panel 200. The head units 100*a* and 100*b* are aligned in a stepped patterned while forming a step difference therebetween.

Thus, it is possible to obtain a compact-sized embroidery machine capable of simultaneously performing the embroidery work with respect to various workpieces. That is, the embroidery machine can perform the embroidery work with respect to workpieces made from finished fabrics through the tubular frame unit 21*b* while performing the embroidery work with respect to cap-shaped workpieces through the cap frame drive unit 21*a* within a limited space.

In addition, a plurality of stepped embroidery machines can be aligned in series such that at least two working groups including a plurality of head units can be formed for embroidering patterns on a plurality of workpieces within a limited space.

Figure 4A:
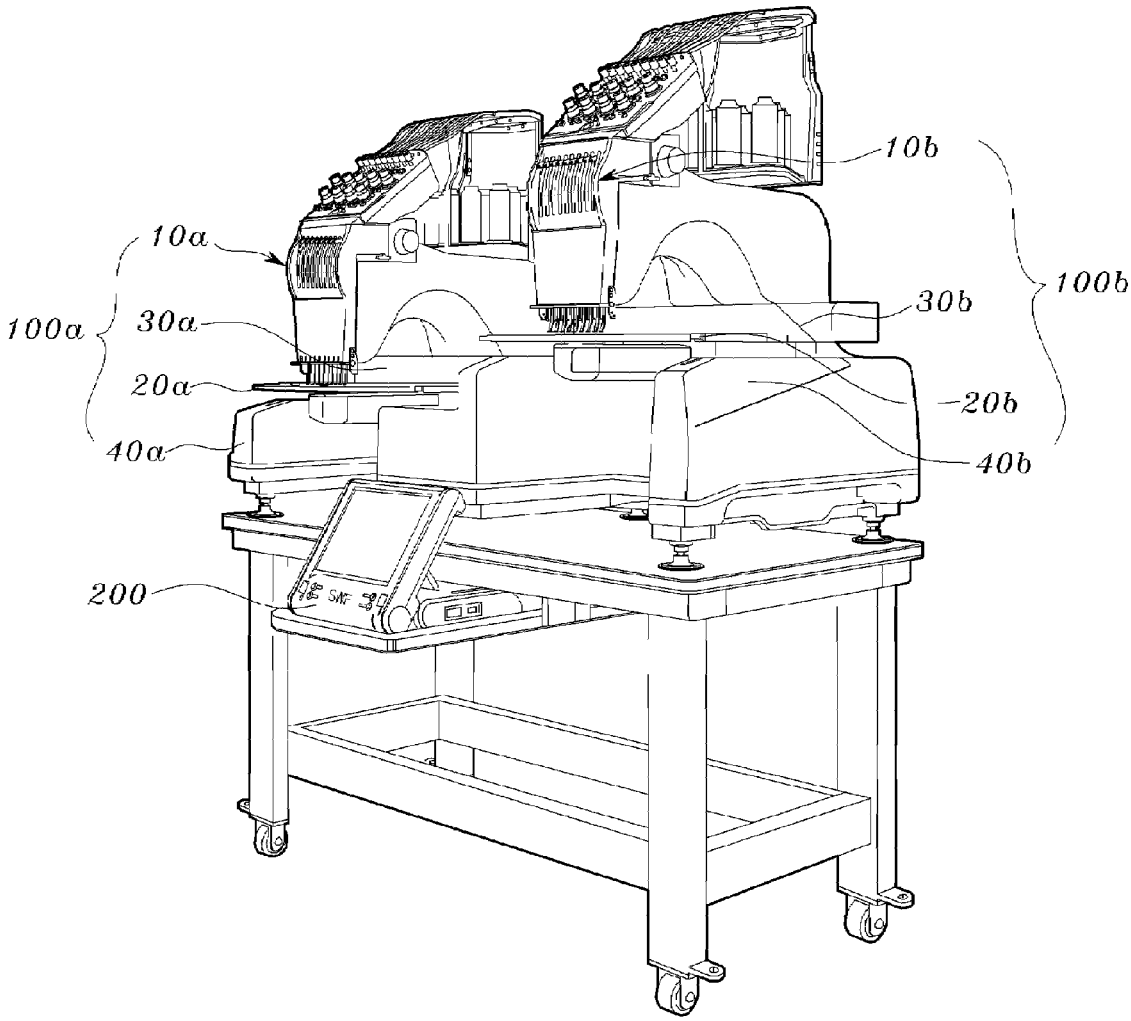
FIGS. 4*a* and 4*b* are perspective and front views illustrating a stepped embroidery machine equipped with a detachable control panel according to another embodiment of the present invention.
Figure 4B:
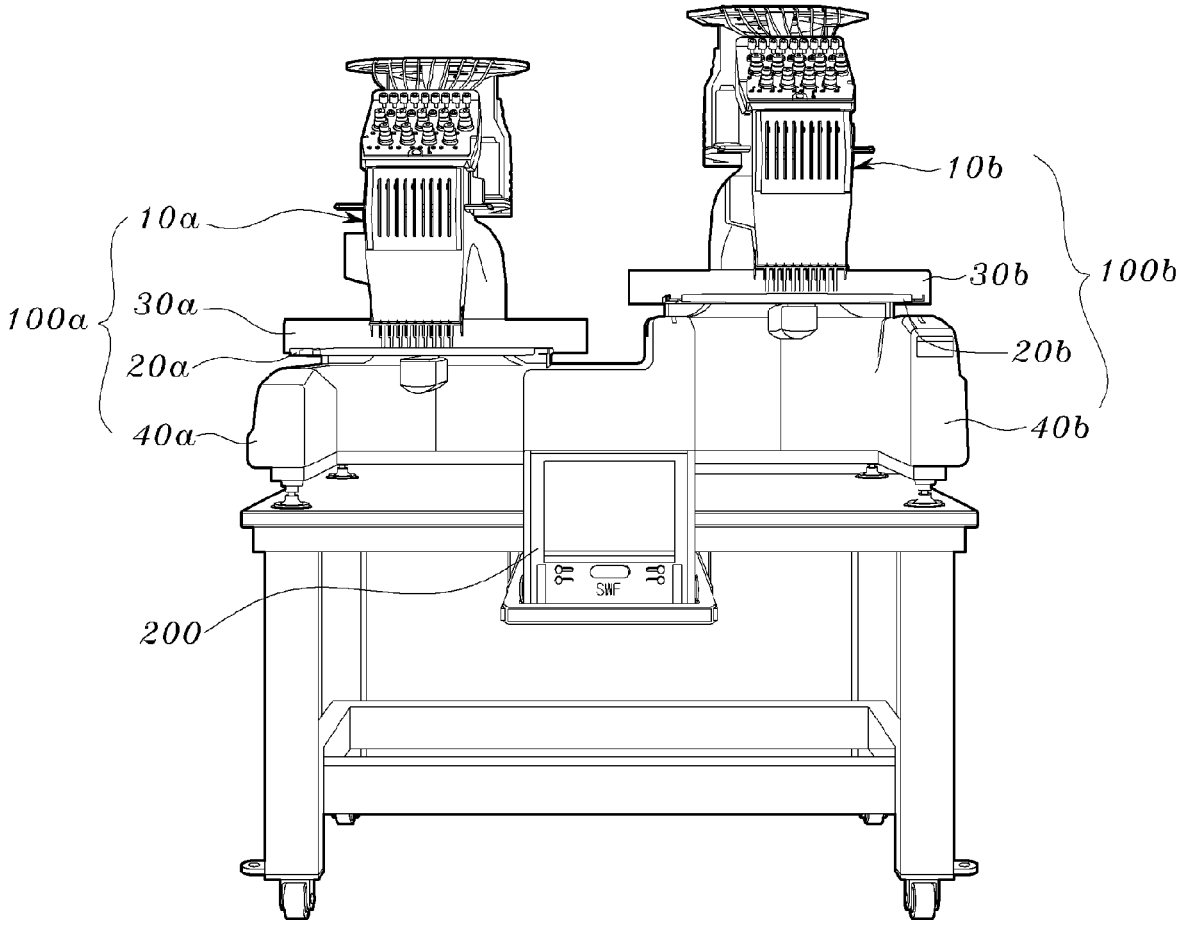

FIGS. 4*a* and 4*b* are perspective and front views illustrating a stepped embroidery machine equipped with a detachable control panel according to another embodiment of the present invention.

Referring to FIGS. 4*a* and 4*b*, the control panel 200, which allows the user to input data required for the embroidery work and transmits the data to the control unit or receives result data from the control unit in order to display the result data in a display screen, is detachably coupled to a body of the embroidery machine. In this case, the control panel 200 is connected to the control unit through a connection wire so that signals can be transmitted between the control panel 200 and the control unit.

Although it is illustrated that the body of the embroidery machine and the control panel 200 are installed on a table, the table is an optional element, which does not directly relate to the present invention, so the table may not affect an influence upon the scope of the present invention.

According to the above embodiment of the present invention, the control panel 200 is detachably coupled to the body of the embroidery machine without being fixed thereto, so that the worker can easily control the operation of the embroidery machine at various positions as required by the worker.

Figure 5A:
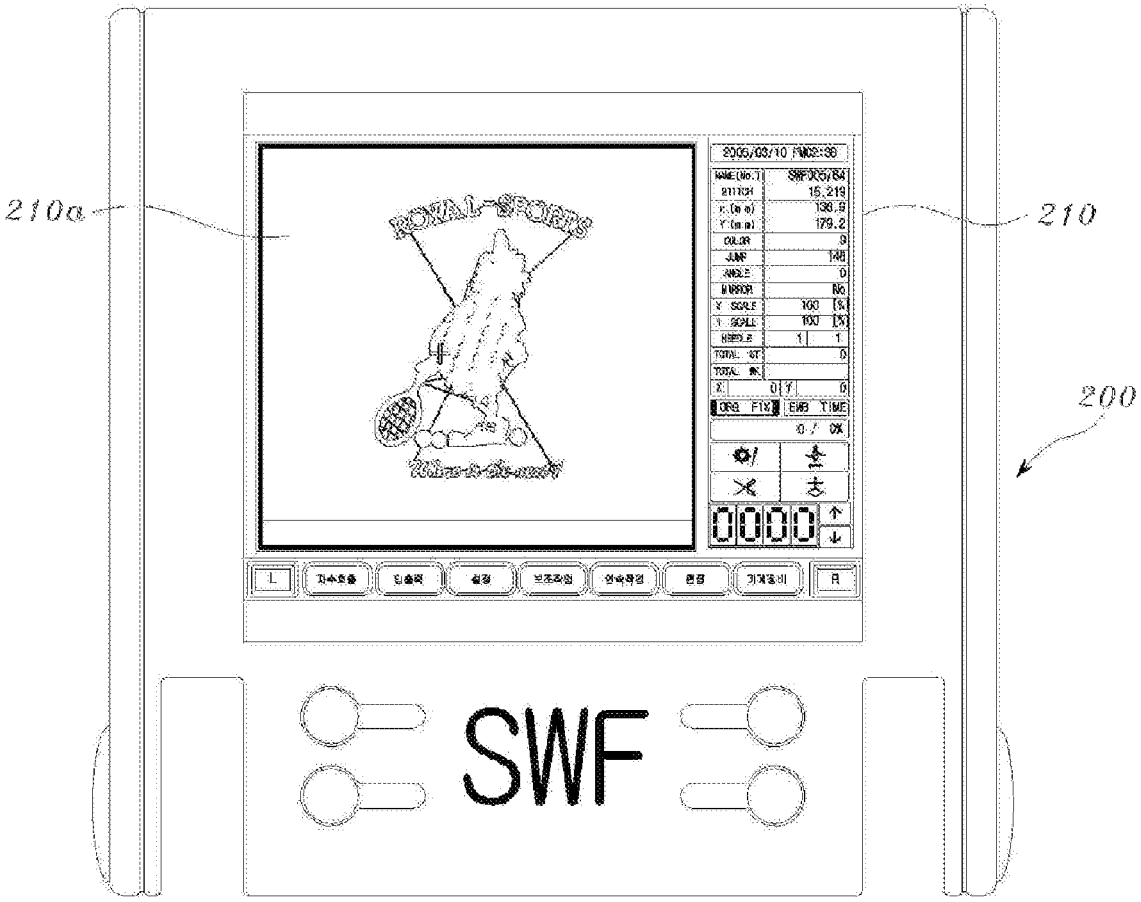
FIGS. 5*a* and 5*b* are views illustrating a display screen formed in a control panel of a stepped embroidery machine according to one embodiment of the present invention.
Figure 5B:
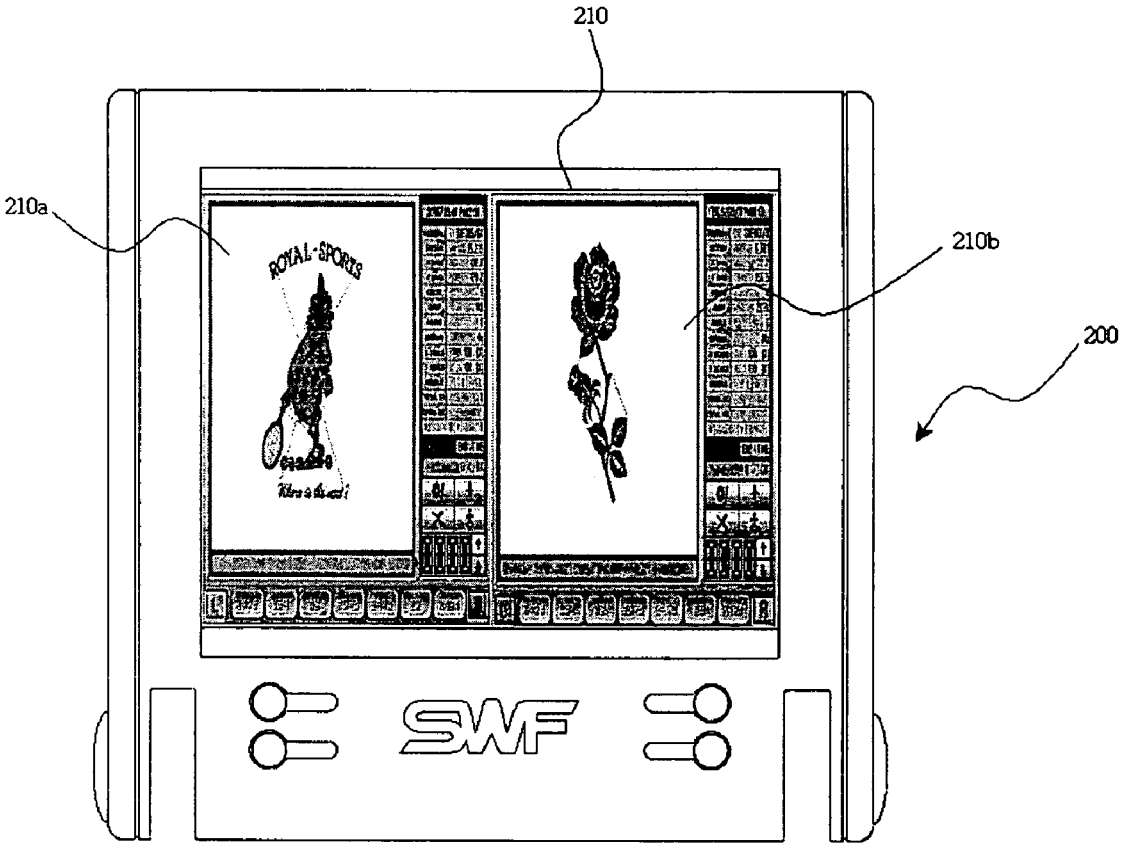

FIGS. 5*a* and 5*b* are views illustrating a display screen formed in the control panel of the stepped embroidery machine according to one embodiment of the present invention, wherein FIG. 5*a* shows a single display screen capable of selectively displaying one of embroidery patterns being embroidered on the workpieces and FIG. 5*b* shows a dual display screen divided into two display parts.

As shown in FIG. 5*a*, the control panel 200 includes a display screen 210 for displaying an embroidery pattern 210*a*, which is selected from various embroidery patterns 210*a* and 210*b* being embroidered on the workpieces by means of head units, together with working information. If the worker wants to display other embroidery pattern 210*b* instead of the embroidery pattern 210*a*, the worker selects the embroidery pattern 210*b* by operating a switch button (not shown) so that the embroidery pattern 210*b* can be displayed in the display screen 210.

In addition, as shown in FIG. 5*b*, the embroidery patterns 210*a* and 210*b* being embroidered on the workpieces by means of head units can be simultaneously displayed on the display screen 210 of the control panel 200 together with working information by dividing the display screen 210 into two display parts.

As described above, the stepped embroidery machine according to the present invention includes a plurality of head units, which can be individually driven, so that it is possible to individually perform the embroidery work with respect to various workpieces. In addition, since the head units are aligned in the stepped pattern while forming a predetermined step difference therebetween, the head units may not interfere with each other even if the embroidery machine performs the embroidery work with respect to workpieces having a large area. The head units can be controlled by means of one control unit and one control panel, so that the worker can simultaneously control the head units of the embroidery machine without changing positions of the worker, facilitating the embroidery work.

In addition, according to the stepped embroidery machine of the present invention, a plurality of head units are aligned in a stepped pattern while forming a step difference therebetween. Accordingly, the size of the stepped embroidery machine can be significantly reduced so that the stepped embroidery machine can be formed with a compact size suitable for a narrow place and the embroidery work can be individually performed with respect to various workpieces.

Furthermore, a plurality of stepped embroidery machines can be aligned in series such that at least two working groups are formed for embroidering patterns on a plurality of workpieces within a limited space.

In addition, the control panel of the stepped embroidery machine can be detachably coupled to the body of the embroidery machine so that the worker can easily control the operation of the stepped embroidery machine by using the control panel without changing the positions of the worker.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A stepped embroidery machine comprising:

a plurality of head units including heads, embroidery frames installed at lower portions of the heads in such a manner that the embroidery frames are movable in X-axis and Y-axis directions, X-axis drive units for moving the embroidery frames in an X-axis direction, and Y-axis drive units for moving the embroidery frames in a Y-axis direction;

a control unit for controlling an operation of the head units; and a control panel used for inputting and displaying information related to embroidery work and embroidery, wherein the head units are individually driven per each head unit and aligned in a stepped pattern while forming a predetermined step difference therebetween.

2. The embroidery machine as claimed in claim 1, wherein the embroidery frames of the head units are overlaid with each other in a stepped pattern at a maximum operational range thereof.

3. The embroidery machine as claimed in claim 1, wherein each embroidery frame of the head unit includes at least one of a tubular frame unit and a cap frame drive unit.

4. The embroidery machine as claimed in claim 1, wherein only one control unit is provided in order to control an operation of the head units in such a manner that the head units simultaneously embroider same embroidery patterns or mutually different embroidery patterns on workpieces.

5. The embroidery machine as claimed in claim 1, wherein only one control panel is provided in the embroidery machine.

6. The embroidery machine as claimed in claim 5, wherein the control panel includes a detachable control panel.

7. The embroidery machine as claimed in claim 5, wherein the control panel includes a display screen for displaying an embroidery pattern, which is selected from various embroidery patterns being embroidered on workpieces by means of the head units according to a selection of a worker.

8. The embroidery machine as claimed in claim 5, wherein the control panel includes a display screen for simultaneously displaying various embroidery patterns being embroidered on workpieces by means of the head units by dividing the display screen into several display parts.

* * * * *